United States Patent [19]

Elko

[11] 4,171,799

[45] Oct. 23, 1979

[54] FRAME ASSEMBLY JIG

[76] Inventor: George A. Elko, R.F.D. No. 5, Box 625, Petersburg, Va. 23803

[21] Appl. No.: 918,710

[22] Filed: Jun. 26, 1978

[51] Int. Cl.[2] ..... B25B 1/20

[52] U.S. Cl. ..... 269/42; 269/108

[58] Field of Search ..... 269/41-42, 269/108, 130

[56] References Cited

U.S. PATENT DOCUMENTS 1,053,556 2/1913 Bergstrom ..... 269/108

FOREIGN PATENT DOCUMENTS 717381 10/1931 France ..... 269/108

*Primary Examiner*—Robert C. Watson

[57] ABSTRACT

An assembly jig including a flexible binder that encircles an assembly of frame members having mitered ends, the binder being attached to a draw bar guided along a guide section of a main support. The support is attached to an angle member against which two of the frame members meet to form a corner of the frame, and the guide section is in the same plane as the frame and extends at an obtuse angle away from each of the two frame members that form the corner. A threaded rod journaled in the main support engages a matching threaded opening in the draw bar to pull the draw bar along the guide section as the rod is turned, thereby exerting tension on the binder to draw all of the mitered frame members into proper alignment and to hold them in that position under pressure while they are being permanently joined to one another by glue or other suitable means.

7 Claims, 4 Drawing Figures

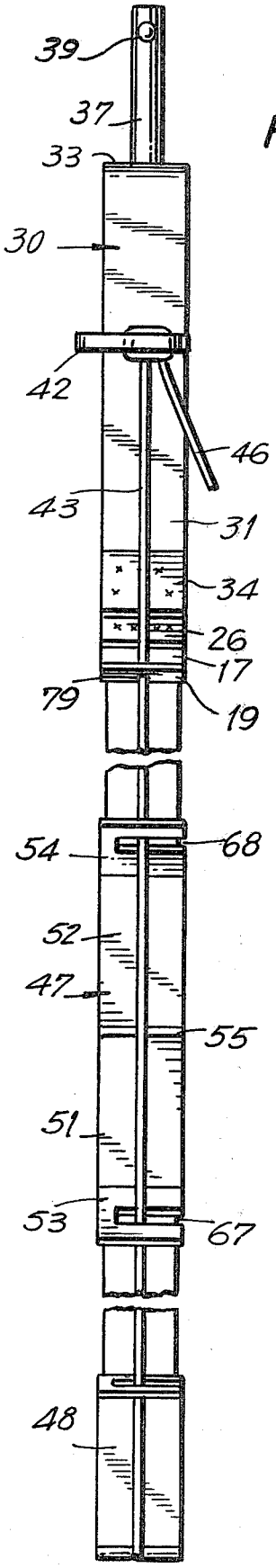
FIG. 4
FIG. 2
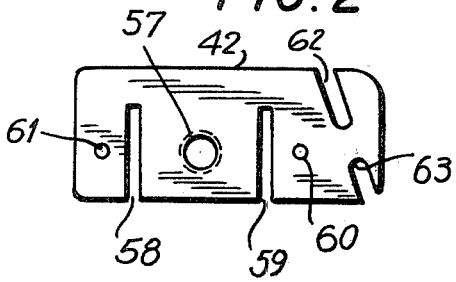
FIG. 3
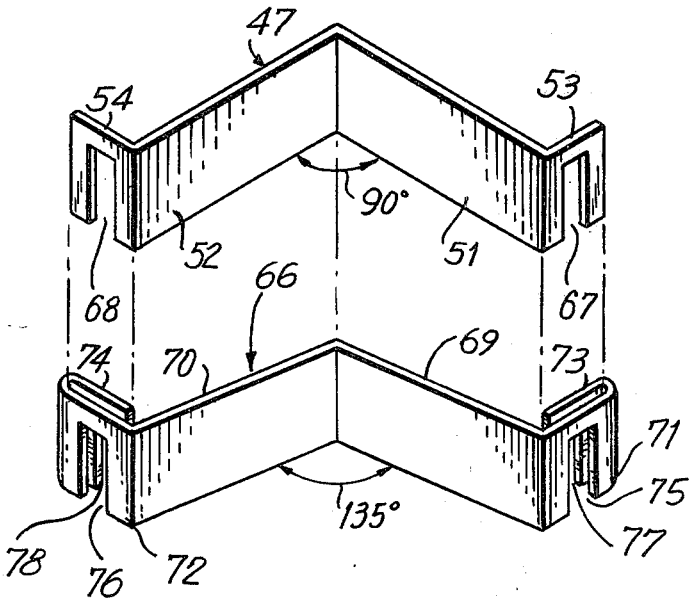

FRAME ASSEMBLY JIG

BACKGROUND OF THE INVENTION

1. Field of the Invention

This invention relates to the field of assembly devices operating by tension to draw frame members into proper alignment and to hold them firmly in place while they are being glued or otherwise fixedly joined together.

2. The Prior Art

The concept of achieving a clamping structure by encircling an assembly of wooden strips by a flexible binder element and applying tension to the binder to hold the strips firmly in place is described in U.S. Pat. No. 2,691,996. In that patent, an assembly of boards is held together to produce a hollow nold into which wet concrete may be poured to form a concrete column. The boards that constitute the mold extend in the longitudinal direction of the column and are held together by several frames, each consisting of wooden strips perpendicular to the boards. The wooden strips are not mitered, and the concept of self-jigging is not considered. One end of the flexible binder element is affixed to one corner member, or bed plate, that fits against two walls of the mounting frame at one of the corners, and the other end of the binder, after being wrapped almost entirely around the frame, is attached to a structure that is threadedly engaged with a bolt supported on the corner member to apply tension to the binder by rotation of the bolt. While the binder will apply tension to hold the wooden strips that constitute the mounting frame in place around the boards once the boards and mounting frame have been properly assembled, the lack of self-jigging of the wooden strips makes assembly undesirably difficult. The arrangement of the tightening bolt so that its axis is substantially parallel to one of the frame members would make the structure difficult to apply to assembly of a picture frame.

U.S. Pat. No. 3,224,754 shows a framing device in which a flexible binder encircles mitered frame members and is threaded through corner pieces at each corner. However the ends of the binder are connected to a turnbuckle located midway along one of the frame members so that the force of the turnbuckle is applied directly in line with the sections of the binder attached directly to it. This location of the turnbuckle requires that the handle of the turnbuckle be constantly worked back and forth as the turnbuckle body is rotated to increase tension in the binder. In each revolution of the turnbuckle, each end of the handle will come into contact with the frame member adjacent to which the turnbuckle is located, so that free rotation of the turnbuckle is impossible.

U.S. Pat. No. 3,610,612 shows a picture frame assembly structure that has four corner pieces to fit around the four corners of the frame. However one pair of these corner pieces is threaded onto a first guide rod and the other pair is threaded onto a second guide rod to assure that the respective pairs of corner pieces can only move longitudinally along the guide rods as a result of tensioning force applied to the corner members by a cord wrapped around them. The ends of the cord are wrapped around an axle parallel to one of the frame members when the frame members are assembled, and thus the tension in the cord is not properly distributed with respect to the frame members nor with respect to the axle.

U.S. Pat. No. 4,047,710 shows a framing clamp with corner members mounted in guide ways to assure that the frame members engaged by the corner members are assembled at the proper angles when force is applied to a binder that encircles all of the corner members. This complex structure does not properly make use of the self-jigging relationship of mitered frame members. In addition, the binder is wrapped around an axle alongside one of the frame member locations but spaced away from that frame member. The location of the axle about which the ends of the binder are bound makes use of a complex binding system.

OBJECTS AND SUMMARY OF THE INVENTION

It is one of the objects of the present invention to provide a simple assembly jig for assembling picture frames and the like quickly and easily, making use of the self-jigging features of mitered frame members, and applying a force by way of a tensioning assembly located at one corner of the frame and extending at an obtuse angle away from the two frame members that intersect to form that corner. The tensioning member holds in tension a binder that encircles the frame and is easily drawn tight and held that way while the frame members are being permanently joined together.

Other features will become apparent from the following specification together with the drawings.

In accordance with the present invention, mitered frame members that make up a picture frame or the like are placed approximately in correct relationship to each other and are encircled by a bander such as a wire or strap connected to a draw bar. At one corner where two of the frame members come together, an angle member fits against these two frame members, and a main support attached to the angle member extends away from the frame members at an angle to each of them. The support includes a draw bar guide that extends at an obtuse angle to each of the frame members that come together at the angle member, and a threaded rod engages the draw bar to move the latter along the guide section as the threaded rod is rotated. Because the rod extends away from both of the frame members closest to it, it can easily be rotated by continuous movement without any interference from any of the other components of the assembly jig.

BRIEF DESCRIPTION OF THE DRAWINGS

FIG. 2 is a plan view of a draw bar for use in the frame assembly jig of FIG. 1.

FIG. 3 is an exploded perpective view of corner members for use in the frame assembly jig of FIG. 1.

FIG. 4 is a side view of the frame assembly jig of FIG. 1.

DETAIL DESCRIPTION OF THE INVENTION

Figure 1:
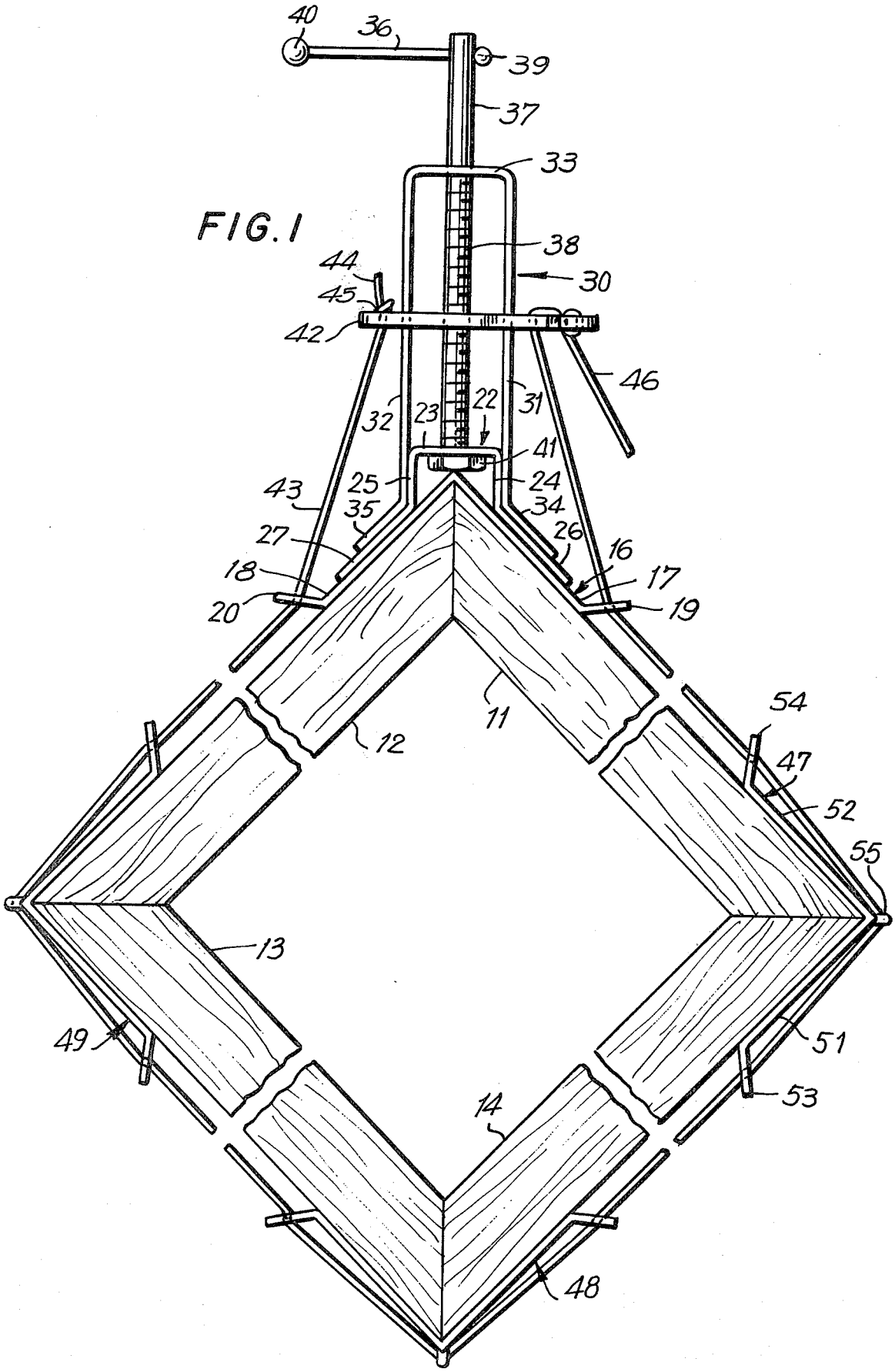
FIG. 1 is a front elevational view of a frame assembly jig according to the present invention.

FIG. 1 shows a frame assembly jig according to the present invention as used in assembling a rectangular frame comprising four frame members 11–14, each of which is mitered at both ends. The main member of the frame assembly jig includes an angle member 16 that comprises first and second frame-engaging parts 17 and 18 with first and second binder guides 19 and 20 at the respective outer ends thereof. All of the parts of the angle member 16 are preferably formed of a single strip of metal bent so that the first and second frame-engaging parts 17 and 18 meet at a right angle. The first and second binder guides may be bent at any suitable angle with respect to the frame engaging parts from which they extend; in FIG. 1, the angle between each of the frame engaging parts and its binder guide is approximately 135°.

A journal guide 22 extends over the corner at which the first and second frame engaging parts 17 and 18 meet. The guide 22 includes at first bridge section 23 with legs 24 and 25 extending from opposite ends thereof. First and second base members 26 and 27 extend from the legs 24 and 25, respectively, and are attached to the frame engaging parts 17 and 18 by any suitable means, such as being spot-welded thereto. Preferably the legs 24 and 25 are perpendicular to the bridge 23 and the base members 26 and 27 are at an angle of 135° with respect to the legs. This causes the base members to be at an appropriate 90° angle with respect to each other, and by extending for some distance along the respective frame engaging parts 17 and 18, the base members 26 and 27 serve as reinforcements to prevent the 90° angle between the two frame engaging parts from being changed as a result of forces applied when a frame assembly jig is in use.

The main member of the frame assembly jig further includes a draw bar guide section 30 that comprises first and second parallel rails 31 and 32 joined together at one end by a bridge 33 and having attachment portions 34 and 35 extending outwardly from the other ends of the respective rails 31 and 32. The angle between each of the attachment portions 34 and 35 and the respective rails 31 and 32 is preferably about 135° so that the attachment portions are at an angle of 90° with respect to each other. These attachment portions are joined to the base members 26 and 27 by any suitable means, such as by being spot-welded thereto. This further reinforces the frame engaging parts 17 and 18 to hold them rigidly in place against forces incurred when the frame assembly jig is in use.

A rod 37 threaded at least along a substantial portion 38 at, or near, one end thereof extends through aligned holes in the bridges 23 and 33. A handle 36 extends through a hole (not shown) bored through the rod 37 near the outer end thereof. The handle includes enlarged members 39 and 40 to hold it in place in the rod 37. The rod is held in place with respect to the bridges 23 and 33 by any suitable means, such as by means of a nut 41 threaded onto the end of the rod sufficiently far to be held in place, and being permanently attached to the rod by any suitable means, such as by being staked thereto.

A draw bar 12 is threaded onto the section 38 of the rod after the rod has been inserted through the guide hole in the bridge 33 but before it has been inserted through a similar, aligned guide hole in the bridge 23. The draw bar is sufficiently thick to engage the thread of the threaded section 38 over a sufficient length to allow the draw bar to be moved longitudinally along the rod 37 as the rod is turned. The draw bar engages the rails 31 and 32 to be guided by these rails, which prevent the draw bar from simply turning as the rod 37 turns.

In this embodiment a binder 43, which could be a web, or strap, of a suitable fabric, such as nylon or any other material having sufficient tensile strength, or which could be a cord of suitable material, such as wire or nylon, is attached to the draw bar 42. In the embodiment illustrated, the binder 43 is a nylon cord, and one end 44 extends through an opening in the draw bar 42 and is held in place by a knot 45. The other end 46 of the binder extends through another opening in the draw bar 42 and is held in place by any suitable means, such as by being wrapped around the draw bar. The binder 43 may be of sufficient length to encircle any desired size of frame members 11–14 after such members are loosely assembled into the general configuration desired. Thus, although the binder 43 appears to be only just long enough to extend around the assembly of frame members 11–14, with the end 46 terminating close to the draw bar 42, the binder may be much longer, and the end 46 may be curled into a suitable loop from which a much greater length of binder could be unwound to accommodate frame members of much greater total length. The binder 43 fits into suitable apertures in the first and second binder guides 19 and 20 that hold the binder relatively close to the first and second frame members 11 and 12 respectively. After passing through the apertures in the binder guides 19 and 20 the binder 43 encircles the entire assembly of frame members 11–14.

If the binder 43 consists of a strap, or web, of material, it may be wrapped directly around the frame members and in contact with them, especially in contact with the frame members 13 and 14. In that case, rotation of the handle 36 in the direction to move the draw bar 42 along the section 38 toward the bridge 33 will draw all of the frame members 11–14 into the most compact arrangement that they can achieve, which will automatically align the two frame members 11, 12 and 12, 13 and 13, 14 and 14, 11 at the respective mitered corners thereof. Before the frame members are so compressed together, a suitable amount of glue may be placed on each of the mitered ends so that when the frame members are brought into alignment in the manner just described, they may be held in that condition by the frame assembly jig until the glue has set. Assembling the frame members 11–14 in this way takes only a moment or two and is a great deal faster than clamping each pair of frame members in a vise and gluing one corner at a time. Furthermore, since all four of the frame members 11–14 are assembled simultaneously, there is no difficulty in making certain that each of the frame members is properly aligned with respect to the other two frame members attached to it, thereby making the frame perfectly rectangular.

In the embodiment in FIG. 1 in which the binder 43 is a nylon cord, it is preferable to provide three additional corner members 47–49 so that the nylon cord 43 will not touch the frame members at the corners and thereby possibly create small notches therein as tension is applied to the nylon cord 43. Each of the three corner members 47–49 is identical to the others, and therefore only the corner member 47 will be described. This includes two frame engaging parts 51 and 52 with binder guides 53 and 54 extending from the outer ends thereof. The frame engaging parts 51 and 52 are joined together at the other end, so that all of the sections 51–54 of the corner member 47 may be formed of a single metal strip and in fact may be identical with the angle member 16. However, it is unnecessary to have any reinforcement of the frame engaging sections 51 and 52 since the force applied by the binder 43 through the binder guides 53 and 54 does not tend to draw the frame engaging sections 51 and 52 apart but forces them to lie directly in contact with the frame members 11 and 14, respectively. A U-shaped loop 55 may be spot-welded at the point of intersection of the frame engaging members 51 and 52, and the nylon binder cord 43 may be threaded therethrough to hold it in place. However the loop 55 is not necessary since there is no tendency for the binder 43 to slip off of the corner member 46 once some tension has begun to be applied to the binder.

FIG. 2 shows the draw bar 42. A threaded central hole 57 is shown midway between two slots 58 and 59 that fit over the guide rails 31 and 32 respectively. In the embodiment shown in FIG. 1, the guide rails are formed of a metal strip having a cross-section corresponding, generally, to the shape of the slots 58 and 59. In end portions of the draw bar 42 are two holes 60 and 61, the centers of which are preferably along the same center line as the center of the threaded hole 57. This prevents the tension of the binder 43 from tending to twist the draw bar 42 and prevent it from moving along the rails 31 and 32 in FIG. 1. First and second notches 62 and 63 are formed in one end of the draw bar near the hole 60 to facilitate wrapping the end 46 of the binder around the draw bar to hold that end of the binder in place.

The assembly jig has been described thus far in a form suitable to assemble four frame members, such as the members 11–14 in FIG. 1, into a rectangular frame. However it is occasionally desirable to assemble a greater number of mitered frame members together. For this purpose, the 90° angle between the frame engaging parts 17 and 18 of the angle member 16 and the frame engaging parts 51 and 52 of the corner member 47 and the other corner members would not be suitable. In accordance with this invention, an insert 66 may be slipped in place over the angle member 16 and over each of the corner members 47–49 in a manner illustrated in FIG. 3. The corner member 47 in FIG. 3 is modified slightly from that in FIG. 1 in that the binder guides 53 and 54 are bent to be perpendicular to the respective frame engaging members 51 and 52. This is of no particular importance with respect to the corner members 47, but since the same structure may be used as the angle member 16, and since the tension in the binder 43 tends to bend the binder guides 19 and 20, shown in FIG. 1, to be more nearly perpendicular to the respective frame engaging parts 17 and 18, it may be desirable to form the binder guides of all of the frame engaging parts to be perpendicular with respect to those frame engaging parts. The openings for the binder are illustrated in FIG. 3 as being slots 67 and 68 open at one side to allow the binder 43 to be easily inserted therein.

The additional member 66 to be assembled with the corner member 47 includes frame engaging parts 69 and 70 bent from a single strip of metal so as to be at an angle of 135° with respect to each other. This is the proper angle for assembly of an octagonal frame. Each of the frame engaging parts 69 and 70 has a binder guide portion 71 and 72 bent outwardly therefrom at an angle of about 112.5° with respect thereto so that the binder guides 71 and 72 are perpendicular to each other. The outer ends of the binder guides 71 and 72 are bent back so that the binder guides are generally U-shaped. These ends are identified by reference numerals 73 and 74, respectively, and all of the elements 71–74 include suitable aperatures 75–78, respectively to permit the binder 43 shown in FIG. 1 to be inserted therethrough. Moreover, as illustrated in FIG. 3, the U-shaped configurations of the binder guides including the portions 71–74 are shaped and spaced to allow the binder guides 53 and 54 of the corner member 47 to slip into the U-shaped members when it is desired to convert the frame assembly jig from a configuration suitable for a rectangular frame into one suitable for an octagonal frame. Of course, four additional corner members will be required for an octagonal frame.

While the insert 66 is illustrated in a configuration suitable for an octagonal frame, the angle of 135° between the frame engaging parts 69 and 70 may be at some other angle, such as 120°, to fit around a hexagonal assembly of frame members. An assembly having any other number of frame members may be similarily accommodated by the insert 66 to have the proper included angle between the frame engaging parts 69–70.

FIG. 4 shows a side view of the frame assembly jig in FIG. 1 illustrating the manner in which the components are in alignment with each other. Loosely speaking, the components may be said to be in the same plane. More specifically, this plane may be thought of as being the plane occupied by the center of the binder 43. Because of the arrangement of the holes 57 and 60 and 61 in the draw bar 42 as shown in FIG. 2, the axis of the rod 37 is also in this same plane. As a result, the tensile force applied by the draw bar 42 to the binder 43 does not cause the angle member 16 and the corner members, which only the corner members 47 and 48 are shown in FIG. 4, to tilt with respect to each other. This further simplifies assembly of a frame by means of the frame assembly jig.

Because the rails 31 and 32 in FIG. 1 extend at an angle away from both of the frame engaging parts 17 and 18, the handle 36 is removed from any possible interference with any part of the assembled frame members 11–14 and thus can be easily rotated to rotate the rod 37 and thus move the draw bar 42 along the rails 31 and 32. As an additional advantage, the assembled frame members 11–14 held by the frame assembly jig in the manner illustrated in FIG. 1 need not be left on a flat surface, but may be hung on a convenient hook extending just under the bridge 33, for example, while the glue at the mitered corners is drying. After the glue has dried, or after the frame members have been joined together by any other suitable means, the direction of rotation of the handle 36 may be reversed to move the draw bar 42 toward the angle member 16 and release tension on the binder 43.

FIG. 4 also illustrates a modification of the angle member 16 in which the binder guides 19 and 20, of which only the guide 19 is shown, have binder apertures 79 rather than slots 67 and 68 as in the corner member 47. As in FIG. 3, the binder guides 53 and 54 are perpendicular to the frame-engaging parts 51 and 52 rather than at a 135° angle thereto as in FIG. 1. It should be noted that it is desirable to make all bends at either a 90° angle or a 135° angle to simplify production of the components. One advantage of having apertures in the angle member 16 is that apertured guides would be stronger and better able to resist the distorting effect of the tensile forces in the binder 43 than the binder guides 53 and 54 shown on the corner member 47. The latter binder guides are each connected only at one side, which is perfectly adequate for the corner member 47 and the other corner members 48 and 49 in which the force of the binder is directed inwardly, but is less satisfactory for the forces to which the angle member 16 is subjected.

While this invention has been described in terms of a specific embodiment, it will be understood by those skilled in the art that modification may be made therein within the true scope of the invention as defined by the following claims.

What is claimed is:

1. A frame assembly jig to provide automatically aligned and compressed assembly of mitered frame members, the assembly jig comprising:

a sheet metal angle member comprising:

first and second frame-positioning parts forming an angle therebetween to receive abutting ends of first and second frame members, and first and second binder guides on the first and second frame-positioning parts, respectively;

a flexible binder threaded through openings in the binder guides, the binder being long enough to encircle the perimeter of a loose assembly of the frame members to hold the members in assembled loop position;

a main support comprising:

a first sheet metal member bent into a U-shaped configuration comprising first and second straight, parallel rails and a first bridge integrally joined to one end of each of the rails, the other end of the rails being rigidly attached to the angle member, a second bridge rigidly attached to the other end of the rails, and apertures in the first and second bridges aligned along an axis parallel to the rails;

a draw bar comprising:

a plate comprising first and second notches in one side spaced apart corresponding to the spacing between the rails and slidably fitting over the rails, a threaded aperture located in a central region of the draw bar between the notches, and attachment means to receive the binder, the attachment means being located outwardly with respect to the notches and substantially in line with the threaded aperture, end portions of the binder being attached to the draw bar at the attachment means with sufficient slack between the end portions to encircle the loose assembly of the frame members;

a threaded rod journaled in the apertures in the first and second bridges extending parallel to the first and second rails, the threaded aperture of the draw bar being threaded onto the rod, the binder being attached to the draw bar attachment means, one end of the rod bearing against the angle member, whereby rotation of the rod presses the rod against the angle member and moves the draw bar longitudinally along the rails to exert tension in the binder, the tension being divided along both the first and second frame members to draw all of the frame members into aligned and compressed assembly.

2. The frame assembly jig of claim 1 in which the outer ends of the first and second frame-positioning parts are turned up, and the openings in the binder guides through which the binder is threaded are holes pierced through the upturned outer ends of the first and second frame-positioning parts.

3. The frame assembly jig of claim 1 in which the main support comprises footing members rigidly attached to and extending along each of the first and second frame-positioning parts to reinforce the frame-positioning parts against bending force applied to them by tension of the binder in the respective first and second binder guides.

4. The frame assembly jig of claim 1 in which the binder is picture frame wire, and the draw bar comprises first and second holes to receive first and second ends of the picture wire, the first and second holes being substantially in line with the first and second binder guides, respectively, whereby the binder is directed in substantially a single plane around the frame members.

5. The frame assembly jig of claim 1 comprising, in addition, a plurality of additional angle members, one of the additional angle members being located at each intersection between a pair of frame members, and each of the additional angle members comprising first and second binder guides, respectively, to guide the binder entirely around the assembly of frame members.

6. The frame assembly jig of claim 5 comprising sheet metal inserts engageable with each of the corner members and the angle member and having frame-engaging parts defining an angle therebetween greater than 90° to accommodate frames having more than four frame members, the frame-engaging parts comprising outer ends folded back to fit around the binder guides of each of the respective angle members.

7. The frame assembly jig of claim 6 in which the outer ends of the frame-engaging parts comprise U-shaped notches to fit over the binder without requiring removal of the binder from the angle member.

* * * * *